United States Patent [19]

Triponez

[11] Patent Number: 5,001,686

[45] Date of Patent: Mar. 19, 1991

[54] WATCH CASE INCLUDING A BASEPLATE-CASEBAND BORNE BY TWO LONGITUDINAL STRUTS

[75] Inventor: André Triponez, Lamboing, Switzerland

[73] Assignee: ETA SA Fabriques d'Ebauches, Granges, Switzerland

[21] Appl. No.: 489,337

[22] Filed: Mar. 6, 1990

[30] Foreign Application Priority Data

Mar. 7, 1989 [CH] Switzerland ..... 830/89

[51] Int. Cl.[5] ..... G04B 37/00

[52] U.S. Cl. ..... 368/282; 368/294; 368/295; 368/286

[58] Field of Search ..... 368/281, 282, 286, 294–296

[56] References Cited

U.S. PATENT DOCUMENTS

| | | | |
|---|---|---|---|
| 1,786,762 | 12/1930 | Lyons . | |
| 3,585,794 | 6/1971 | Kiligenberg | 368/281 |
| 3,726,082 | 4/1973 | Kushida | 58/88 |
| 4,493,561 | 1/1985 | Bouchet | 368/282 |
| 4,696,577 | 9/1987 | Muller et al. | 368/276 |

FOREIGN PATENT DOCUMENTS

| | | | |
|---|---|---|---|
| 0082119 | 6/1983 | European Pat. Off. . | |
| 0109997 | 6/1984 | European Pat. Off. | 368/282 |
| 784133 | 7/1935 | France . | |
| 2272433 | 12/1975 | France . | |
| 0028681 | 2/1990 | Japan | 368/282 |
| 194225 | 11/1937 | Switzerland . | |
| 652885 | 12/1985 | Switzerland . | |

*Primary Examiner*—Bernard Roskoski

*Attorney, Agent, or Firm*—Griffin Branigan & Butler

[57] ABSTRACT

The wrist watch of this invention includes a caseband (18) and a baseplate (20) formed as a single piece to give a baseplate-caseband (10). The baseplate-caseband is entirely coated by a thin protective layer (60) of substantially constant thickness. In order to protect the portions of the caseband exposed to exterior stresses (shocks etc.) the baseplate-casband is borne by two longitudinal struts (1) fastened on either side of the caseband. These struts are provided in a manner such that they exhibit a greater resistance to said exterior stresses than does the baseplate-caseband. In particular the longitudinal struts (1) are coated with a protective layer (61) of greater thickness than the layer (60) which coats the baseplate-caseband.

10 Claims, 2 Drawing Sheets

WATCH CASE INCLUDING A BASEPLATE-CASEBAND BORNE BY TWO LONGITUDINAL STRUTS

This invention concerns a wrist watch including a metallic caseband, a baseplate on which is assembled a movement provided with a time display, the baseplate being integral with the caseband so as to form a baseplate-caseband, a crystal and a back cover respectively mounted on the upper and lower faces exhibited by the caseband, first and second packings being respectively interposed between the crystal and the caseband, and between the back cover and said caseband.

BACKGROUND OF THE INVENTION

A watch in which the baseplate and the caseband are integrally formed is known from the patent document No. EP-A-0 216 223 (U.S. Pat. No. 4 696 577). In this watch the baseplate caseband is formed of brass which material has the advantage of permitting easy machining thereof, but which is very much subject to oxidation. In order to prevent such oxidation, the baseplate is coated with a layer of nickel or of gold, the total thickness of which generally does not exceed two microns. This is sufficient to protect the brass while modifying to a minimum the tolerances of the baseplate. This thickness is at the same time not sufficient to protect the exposed portions of the caseband which is subject to numerous attacks or stresses such as shocks or abrasion. Also the invention described in the cited document suggests coating the exposed parts, in particular the outer edge of the caseband, with a protective layer thicker than the thickness of the layer covering the baseplate. This leads to a manufacturing problem which is resolved by several successive operations and which consists in coating the baseplate with a thin protective layer, then stacking several baseplate-casebands onto one another and coating the visible parts of such assembly with a thick protective layer. Following disassembly, each baseplate-caseband exhibits an edge resistant to outer solicitations.

The patent document No. EPA-0 082 119 describes a watch case caseband the lateral faces of which are protected by a semi-cylindrical cover strip formed of corundum. The cover strip is glued in a groove of the same form milled in the edge of the caseband. It will be noted however that this arrangement does not have as purpose the protection of a watch case, the baseplate and the caseband of which are formed integrally and are covered with a protective layer of substantially constant thickness as is the case in the present invention. Furthermore, the cover strips of the cited document do not serve as means for fastening a bracelet. It is thus not seen how the teaching of this document combined with that of the precedingly cited document could suggest the presently claimed invention.

SUMMARY OF THE INVENTION

The constructions described in the cited documents necessitate long, complicated and thus troublesome operations. In order to avoid such, the baseplate-caseband forming the wrist watch of this invention is characterized in that it is entirely covered with a protective layer of substantially constant thickness, in that said baseplate-caseband is borne by two longitudinal struts fastened on either side of the caseband and oriented in the sense of the longitudinal direction of the watch bracelet, said struts extending beyond the space occupied by the baseplate-caseband in order to serve as bracelet attachment means and in that said struts are formed in a manner such that they exhibit a greater resistance to exterior stresses than said baseplate-caseband.

The invention will now be understood from the description to follow and which gives by way of example and with the aid of the drawings an embodiment thereof.

DESCRIPTION OF THE PREFERRED EMBODIMENT

Figure 1:
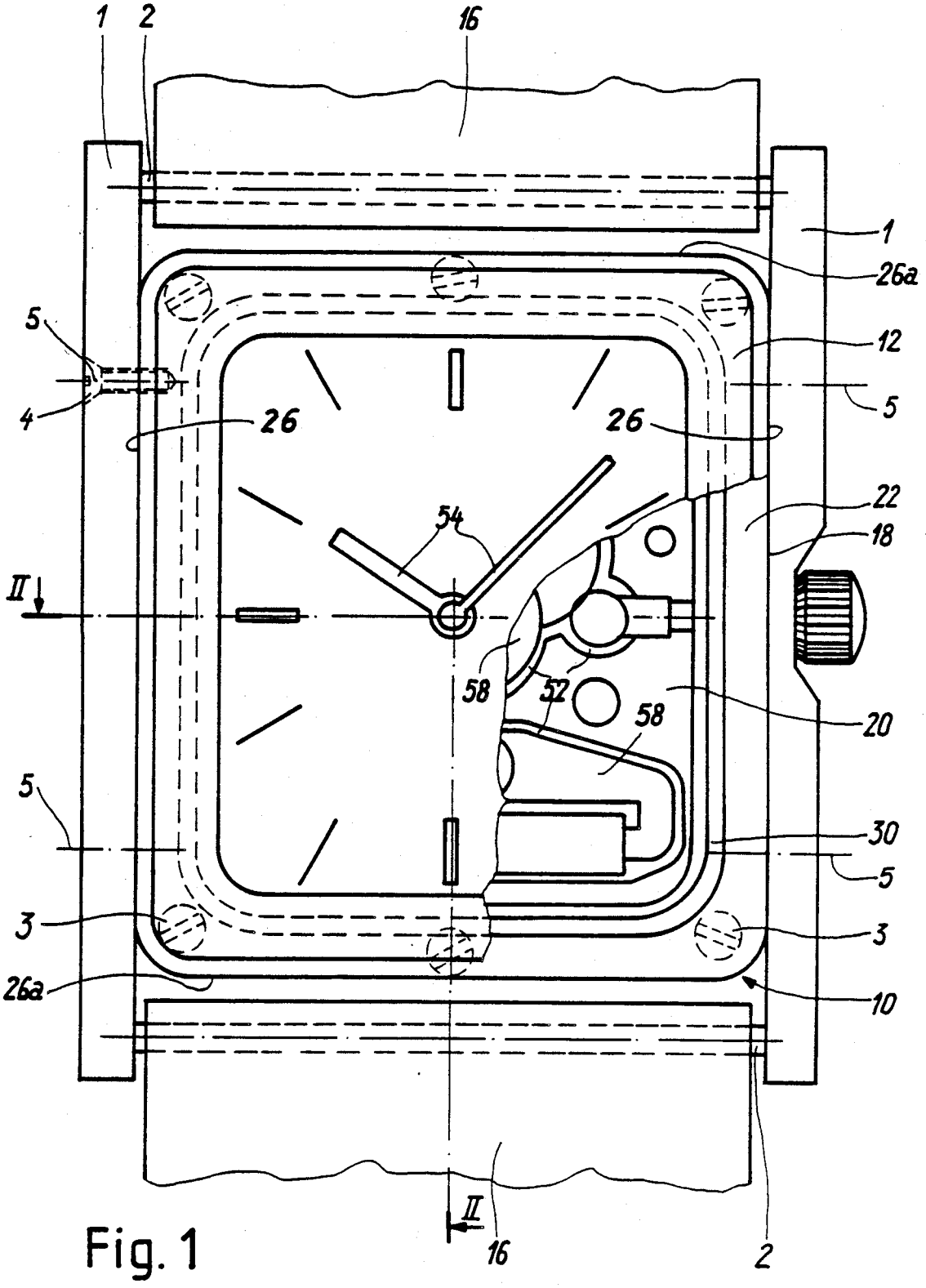
FIG. 1 is a plan view partially broken away of a wrist watch in accordance with the invention.

The watch shown on the drawings includes a baseplate-caseband 10 which is integrally monolithically formed of a continuous mass of metal and includes a part forming a baseplate 20 and a part forming the caseband 18. The caseband 18 is of annular form and entirely surrounds the baseplate 20. The caseband 18 includes an upper face 22 on which is supported a crystal 12. Between the crystal 12 and face 22 there is interposed a moisture sealing packing 30 housed in a groove 28. As may be seen on FIG. 2, face 22 is hidden from view by metallization 6 placed under crystal 12. The crystal is fastened to the upper face of the caseband by gluing for instance and covers entirely the upper face of the caseband. In an analogous manner, the caseband 18 includes a lower face 24 on which is supported a back cover 14. Between back cover 14 and face 24 there is interposed a moisture sealing packing 34 housed in a groove 32. The back cover is fastened onto the lower face of the caseband by means of several screws 3 for instance and covers entirely the lower face of the caseband.

The invention is not limited to the arrangements as described for the crystal and the back cover. The caseband 18 could be provided with an annular flange extending beyond the upper and lower faces and the crystal and the caseband could be driven into the housings thus formed with interposition of packings.

Figure 2:
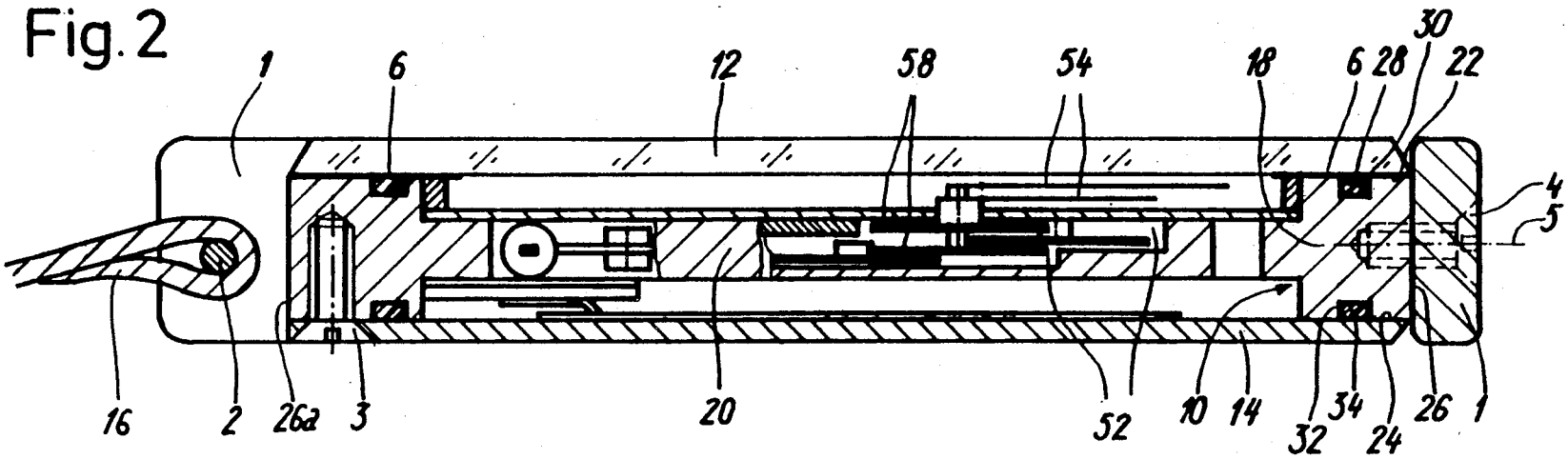
FIG. 2 is a cross-section of the wrist watch along the broken line II—II of FIG. 1.

FIGS. 1 and 2 further show that the caseband 18 exhibits lateral faces 26 and **26*a*. In the wrist watch taken as an example, the configuration of the watch is rectangular, the lateral faces 26 being those which extend in the direction between 6 o'clock and 12 o'clock and the side faces 26*a*** being those which extend in the direction from 3 o'clock to 9 o'clock.

The baseplate 20 includes recesses 52 which define cut-outs in which are housed various components of the watch. Among such components one may note the display means formed by hands 54 as well as the parts forming the drive means, control means and correction for the display means schematically shown at 58.

If, for certain of these recesses, the precision may be relatively low, for others such as the recess **52*a* (FIG. 3) which includes a hole 52*b*, the required precision is much greater. This is due to the fact that hole 52*b*, which acts as a pivot for a wheel set 58*a***, must have a perfectly defined diameter and position in order to guarantee good meshing of the different wheel sets of the watch.

Thus, in order to obtain a metallic baseplate in which even the closest tolerances are respected and the surface of which is protected, this latter is coated by means of a layer 60 of a noble or non-reactive material such as gold or nickel, the thickness of which is between 0.5 and 3 microns, typically 2 microns.

Figure 3:
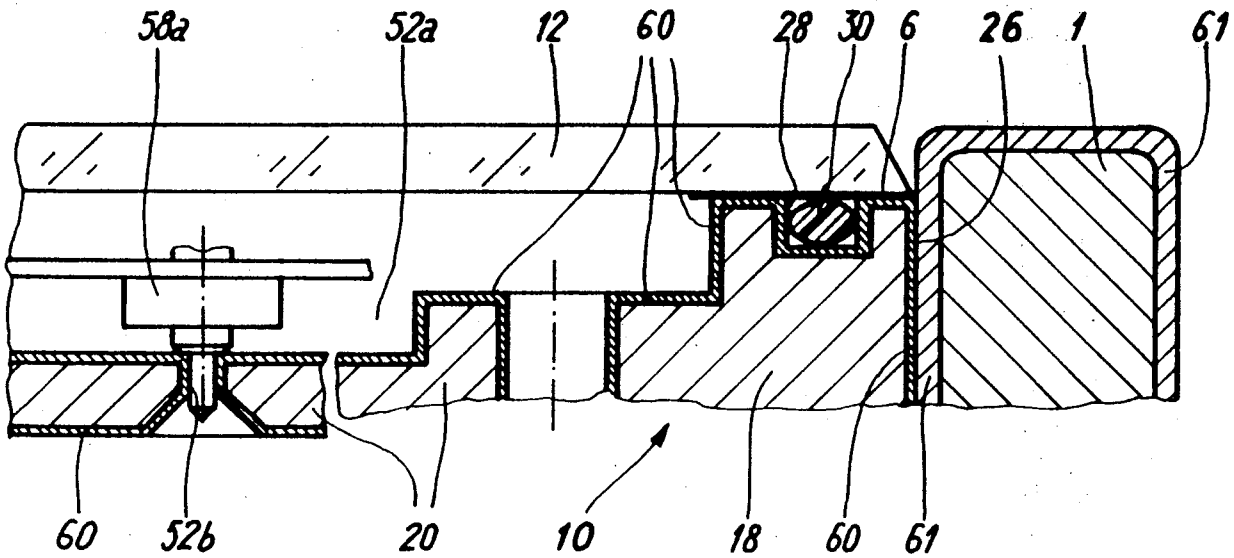
FIG. 3 shows in an enlarged manner a part of the cross-section of FIG. 2.

According to an important characteristic of this invention, the baseplate-caseband 10 formed from the baseplate 20 and the caseband 18, is entirely covered with the protective layer 60, the thickness of which is substantially constant, this layer likewise covering the lateral faces 26, 26*a* of the caseband 18 (see FIG. 3). Thus, contrary to what has been proposed in the patent document No. EP-A-0 216 223, the baseplate-caseband undergoes only one coating treatment which reduces considerably the manufacturing time.

However, if the protective layer 60 is amply sufficient for conserving the aspect of the baseplate 20 which is protected from outer attacks by crystal 12 and back-cover 14, it is not at all appropriate to protect the lateral faces 26 which are subjected to physical attacks such as abrasion or shocks. To overcome this problem another important characteristic of the present invention proposes bearing the baseplate-caseband by two longitudinal struts or beams 1 fastened on either side of the caseband 18 and oriented in the sense of the longitudinal direction of the bracelet attached to the watch, these struts extending beyond the space occupied by the baseplate-caseband, in order to serve as attachment means for a bracelet 16. Thus, these struts serve to protect the lateral faces 26 of the baseplate-caseband 10 and it is they which will be subjected to the external attacks mentioned hereinabove. In order to resist such attacks, another characteristic of the invention provides for forming such struts in a manner such that they exhibit a greater resistance to external agents than the baseplate-caseband as such.

The figures show how the struts 1 are arranged relative to the baseplate-caseband. In particular, FIG. 1 shows two struts 1 oriented in the sense 6 o'clock–12 o'clock and arranged on either side of the caseband 18. In the version as shown, they are fastened by means of screws 4 arranged along axes 5 in the caseband 18. However, other arrangements are possible as will be mentioned further on. The struts 1 project beyond 6 o'clock and 12 o'clock of the watch case in a manner such that they may be employed to attach the bracelet 16 to the watch; this by means of spring bars 2, for instance. It will be noted that the lateral faces 26*a* apparent on FIGS. 1 and 2 covered only by the protective layer 60 coating the baseplate-caseband are not or only slightly solicited by exterior stresses, protected as they are by the presence of bracelet 16. There is thus no necessity to protect these faces more than they have already been protected by layer 60.

It has been mentioned hereinabove that the struts are formed in a manner to present a greater resistance than that exhibited by the baseplate-caseband. To arrive at this objective, several solutions are possible.

A first solution consists in forming the struts of metal, preferably of brass, and coating such brass with a layer 61 of metal which is thicker than that employed to cover the baseplate-caseband. FIG. 3 shows that strut 1 is entirely coated with a protective layer 61. This layer is made of a material which is chemically more inert than brass and more resistant to physical attacks than layer 60. Such material can be chromium, gold, titanium, aluminium or carbides or nitrides of a metal chosen among titanium, vanadium, tungsten, or again a layer of organic material such as a paint or rubber. When the layer 61 is of one of these metals or metallic compounds, its thickness is advantageously between 5 μm and 30 μm, typically, 10 μm. It confers to the exposed zones a resistance far superior to that which may be expected from a piece of brass, even protected by means of a layer 60 of nickel or gold, as is the case with the baseplate-caseband.

These struts may be screwed, riveted, welded or even glued to the baseplate-caseband. If the struts are welded, one will preferably choose a coating 61 identical in nature to the layer 60 covering the baseplate-caseband. Should the struts be screwed onto the baseplate-caseband, the coatings 60 and 61 will be chosen to be at least compatible with one another, i.e. will not exhibit electrical cell characteristics.

Struts 1 may be formed of another material than brass. In choosing aluminium, for instance, one may anodize this which enables obtaining a thin layer which is very resistant and which furthermore may be coloured.

The struts could also be formed by compacting powders, this operation being followed by sintering.

The deposits of metallic layers or metallic compounds indicated hereinabove may be obtained by galvanic methods or by CVD or PVD. One may also choose contrasting tints between the baseplate-caseband and the struts in order to obtain for instance a bicolour presentation. It will be recalled that the primary interest of the invention resides in the fact that the baseplate-caseband and the struts being distinctive components, they may from this aspect be coated independently from one another in a single operation for each of them, and this prior to assembling. One thus avoids the saving operations practised in order to obtain the baseplate-caseband described in the document cited hereinabove.

FIGS. 2 and 3 show that the height of the struts 1 is substantially equal to the overall thickness of the watch. If the crystal 12 is of sapphire and entirely covers the upper face 22 of caseband 18, the height of the struts could be limited to the thickness of the caseband taken between its upper and lower faces which would permit lightening the construction.

If the principal objective of this invention is that of protecting a baseplate-caseband by means of longitudinal struts made to resist exterior attacks, it will be understood that one may benefit from the presence of these struts in order to improve the outer appearance of the watch. These struts shown as two elongated parallelepipedons on the drawings may take other forms less stiff than those illustrated. They may thus harmonize with the baseplate-caseband chosen and could be for instance curved if such baseplate-caseband were round, or further could be decorated in any desired manner.

What I claim is:

1. A wrist watch comprising a monolithic metal baseplate-caseband having a caseband portion and a baseplate portion on which is assembled a movement provided with a time display, a crystal and a back cover respectively mounted on upper and lower faces exhibited by the caseband portion, first and second packings interposed between the crystal and the caseband portion and between the back cover and said caseband portion, respectively, a protective layer of substantially constant thickness entirely covering said baseplate-caseband, said baseplate-caseband being borne by two longitudinal struts, means for fastening said longitudinal struts on either side of the caseband and oriented in the sense of the longitudinal direction of the watch bracelet, said struts extending beyond the space occupied by the baseplate-caseband so as to serve as bracelet attachment means, said struts comprising a material exhibiting a greater resistance to exterior stresses than said protective layer.

2. A wrist watch as set forth in claim 1 wherein said baseplate-caseband comprises brass and said protective layer comprises a metal chosen from the group comprising gold and nickel, the thickness of said protective layer being between 0.5 and 3 um.

3. A wrist watch as set forth in claim 1 wherein the longitudinal struts comprise metal.

4. A wrist watch as set forth in claim 3 wherein the longitudinal struts comprise brass covered with a layer of metal chosen from the group comprising gold; chromium, titanium and aluminum, the thickness of said layer being greater than 5 um.

5. A wrist watch as set forth in claim 3 wherein the longitudinal struts comprise anodised aluminium.

6. A wrist watch as set forth in claim 1 wherein the longitudinal struts comprise compacted sintered powders.

7. A wrist watch as set forth in claim 1 wherein said fastening means comprising screws for attaching said longitudinal struts to said baseplate-caseband.

8. A wrist watch as set forth in claim 1 wherein said fastening means comprises rivets for attaching said longitudinal struts to said baseplate-caseband.

9. A wrist watch as set forth in claim 1 wherein said fastening means comprises welds attaching said longitudinal struts to said baseplate-caseband.

10. A wrist watch as set forth in claim 1 wherein said fastening means comprises glue for attaching said longitudinal struts to said baseplate-caseband.

* * * * *